US008721270B2

(12) United States Patent
Graefe et al.

(10) Patent No.: US 8,721,270 B2
(45) Date of Patent: May 13, 2014

(54) PASSAGE WALL SECTION FOR AN ANNULAR FLOW PASSAGE OF AN AXIAL TURBOMACHINE WITH RADIAL GAP ADJUSTMENT

(75) Inventors: Richard Graefe, Düsseldorf (DE); Carsten Kaufmann, Mülheim a.d. Ruhr (DE); Rafael Labisch, Essen (DE); Marco Link, Duisburg (DE); Oliver Schneider, Wesel (DE)

(73) Assignee: Siemens Aktiengesellschaft, München (DE)

( * ) Notice: Subject to any disclaimer, the term of this patent is extended or adjusted under 35 U.S.C. 154(b) by 440 days.

(21) Appl. No.: 13/104,186

(22) Filed: May 10, 2011

(65) Prior Publication Data

US 2011/0280712 A1 Nov. 17, 2011

(30) Foreign Application Priority Data

May 12, 2010 (EP) ..... 10005053

(51) Int. Cl.
*F01D 11/22* (2006.01)

(52) U.S. Cl.
USPC ..... 415/174.1

(58) Field of Classification Search
USPC ..... 415/173.2, 174.1, 170.1, 173.1; 416/174
See application file for complete search history.

(56) References Cited

U.S. PATENT DOCUMENTS

| | | | | |
|---|---|---|---|---|
| 3,227,418 | A * | 1/1966 | West | 415/127 |
| 4,127,357 | A * | 11/1978 | Patterson | 415/116 |
| 5,203,673 | A | 4/1993 | Evans | |
| 6,672,831 | B2 * | 1/2004 | Brandl et al. | 415/173.2 |
| 7,686,569 | B2 * | 3/2010 | Paprotna et al. | 415/1 |

* cited by examiner

*Primary Examiner* — Richard Edgar

(57) ABSTRACT

A passage wall section of an annular flow passage of an axial turbomachine is provided. A guide ring has a first toothing arrangement which is in contact with a second toothing arrangement arranged on a sidewall of a circumferential groove which accommodates the guide ring, wherein for axial displacement of the displaceable guide ring, the guide ring is rotatable in a circumferential direction.

15 Claims, 1 Drawing Sheet

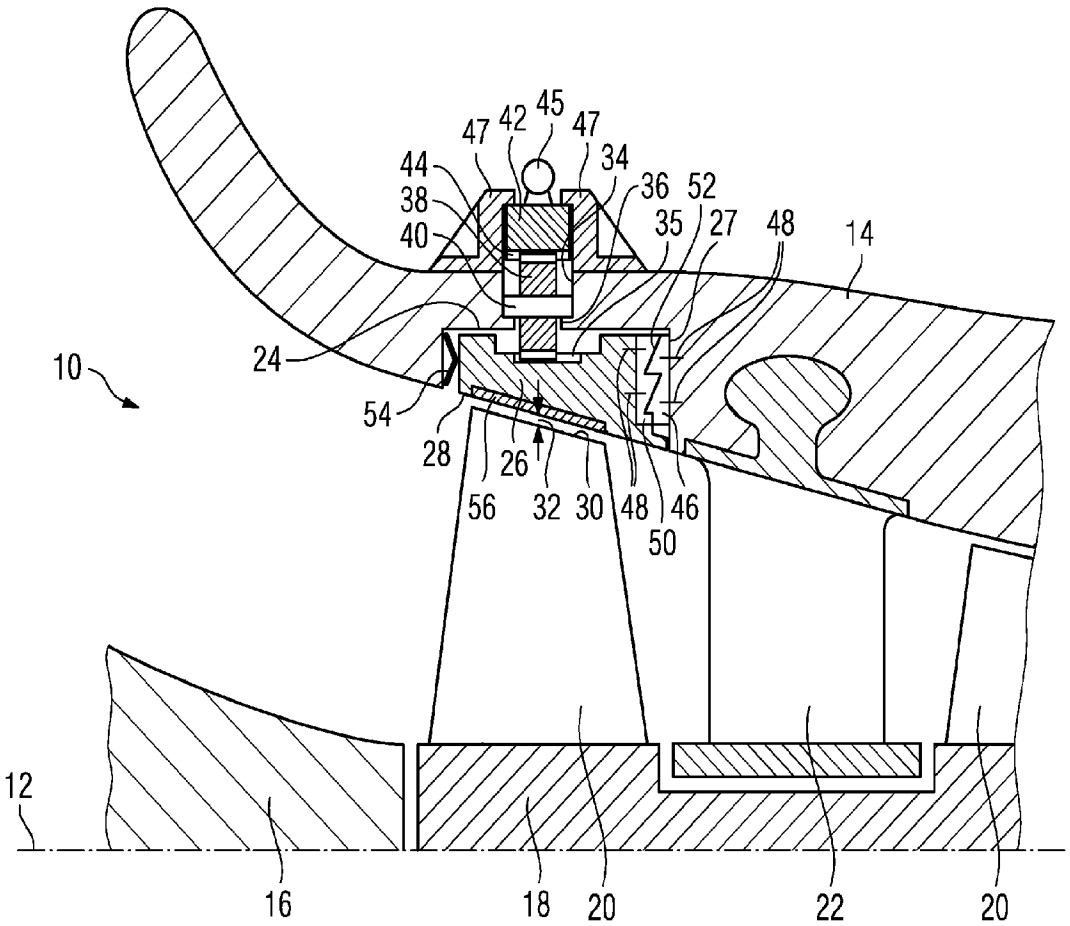
10
12
14
16
18
20
20
22
24
26
27
28
30
32
34
35
36
38
40
42
44
45
46
47
47
48
48
50
52
54
56

PASSAGE WALL SECTION FOR AN ANNULAR FLOW PASSAGE OF AN AXIAL TURBOMACHINE WITH RADIAL GAP ADJUSTMENT

CROSS REFERENCE TO RELATED APPLICATIONS

This application claims priority of European Patent Office Application No. 10005053.3 EP filed May 12, 2010, which is incorporated by reference herein in its entirety.

FIELD OF INVENTION

The invention refers to a passage wall section of an annular flow passage of an axial turbomachine with radial gap adjustment.

BACKGROUND OF INVENTION

Such flow passages are known in many cases. For example, U.S. Pat. No. 5,203,673 discloses such a device for controlling and adjusting radial gaps between the tips of rotor blades and the guide ring which lies opposite these, and is part of the passage wall. In this case, it is provided that in the conical flow passage the guide ring is axially displaceable for adjusting radial gaps. For axial displacement of the guide ring, three hydraulic cylinders, the pistons of which can move parallel to the machine axis of the turbine, are screwed in the stator blade carrier and distributed over the circumference. In conjunction with the conical gap between the wall surface of the guide ring, which delimits the flow path, and the inclined tips of the rotor blades, which correspond thereto, the gap dimension, or the radial distance between wall surface and blade tips, can be adjusted by means of the axial displacement. Resetting is carried out by means of helical springs which move the guide ring back into the original position. At the same time, provision is made for the use of a radial gap measuring system, with which the radial gap can be measured at one point. Depending upon the measured gap dimension, the guide ring is then axially positioned so that a smallest possible gap dimension is achieved while avoiding brushing of the blade tip against the wall surface. However, the use of a plurality of hydraulic cylinders is disadvantageous since some of them can fail. This would lead to skewing of the guide ring in the event of adjustment. A further disadvantage of the device is the rather selective initiation -provided at only three points-of the adjusting force by means of the hydraulic cylinders which is required for axial displacement of the guide ring. Each cylinder therefore has to be able to transmit a comparatively large portion of the overall adjusting force, which necessitates space-consuming cylinders.

SUMMARY OF INVENTION

An object of the invention is to provide a compact passage wall section for an annular flow passage of an axial turbomachine, with which a simple and reliable radial gap adjustment is possible without skewing of the guide ring taking place in the event of failure of one of the hydraulic cylinders.

The object which forms the basis of the invention is achieved with a passage wall section according to the claims.

It is provided that the guide ring—which is arranged in a circumferential groove—on the end face has a first toothing arrangement which is in contact with a second toothing arrangement arranged on a sidewall of the circumferential groove, wherein for axial displacement of the displaceable guide ring this is additionally rotatable in the circumferential direction. The invention is based on the knowledge that the axial position of the guide ring can be adjusted comparatively simply in a defined manner if two toothing arrangements which correspond to each other are permanently in contact, of which one toothing arrangement is fixed and the other toothing arrangement is slightly rotatable in relation to the one toothing arrangement so that on account of the tooth contact surfaces, which are inclined to the displacement direction, a rotation of the toothing arrangement at the same time effects or forces its axial displacement. The first toothing arrangement is to represent the rotatable toothing arrangement which projects on the guide ring on the end face, i.e. projects from a plane perpendicularly to the machine axis of the axial turbomachine. The second toothing arrangement is fixed and arranged on the sidewall of the circumferential groove which lies opposite the first toothing arrangement. Provision is customarily made in each case for a multiplicity of teeth which are equally distributed over the circumference, which leads to the force initiation for adjusting the guide ring being carried out at a correspondingly large number of points so that skewing of the guide ring can be reliably avoided. This also enables a uniform force initiation which is distributed over the circumference. A local failure of the force initiation at only one point of the circumference cannot consequently occur. This leads to a particularly reliable adjustability of the radial gaps which exist between the inner wall surface of the guide ring, which delimits the flow path, and the tips of the blade airfoils of the rotor blades of the axial turbomachine, which rotate past beneath the wall surface.

Advantageous developments are disclosed in the dependent claims.

According to a first advantageous development, the guide ring, by means of a spring element, or a plurality of spring elements which are distributed over the circumference of the circumferential groove, are constantly in pretensioned contact with the second toothing arrangement. An unwanted gap development between the two toothing arrangements can therefore be reliably avoided. This constantly leads to a precisely defined axial position of the guide ring, which results in a precisely defined gap dimension. Disk springs are especially suitable as spring elements.

According to a further advantageous development, the guide ring has an outwardly oriented generated surface with at least one external toothing arrangement in which engage toothed wheels which are distributed over the circumference of the passage wall section and rotatably mounted in this, wherein provision is made for an adjusting ring which encompasses all the toothed wheels and the internal toothing arrangement of which is in engagement with the toothed wheels. As a result, a particularly simple construction, with which the guide ring is rotatable or pivotable in the circumferential direction, can be disclosed. Moreover, the guide ring is radially supported and carried by means of the toothed wheels and the adjusting ring. At the same time, centering of the adjusting ring and of the guide ring can therefore be adjusted. Furthermore, by means of the toothed wheels which are distributed preferably uniformly over the circumference, the force initiation for rotating the guide ring can be carried out at a correspondingly large number of positions, which leads to the external toothing arrangement, the toothed wheels and the internal toothing arrangement being able to be of comparatively small design. This construction saves space and furthermore can be produced inexpensively. Both the external toothing arrangement and the internal toothing arrangement do not have to be designed as an endlessly encompassing toothing arrangement on the adjusting ring or on the guide ring since only a short rotational distance of the guide ring is required for adjusting the radial gaps. Consequently, the external toothing arrangement, which is arranged on the outer generated surface of the guide ring, and/or the internal toothing arrangement, which is arranged on the adjusting ring, is, or are, provided only at those circumferential positions at which provision is also made for toothed wheels in the passage wall section.

The force initiation in the adjusting ring is preferably carried out via hydraulically or electrically operated push rods which act thereupon, as are already known from the prior art. Such actuating devices are also used for adjusting rotatable inlet guide vanes of axial compressors. In most cases, they have only a single actuating unit.

According to a further advantageous development, the flow passage can have two or more of the guide rings in question, which are movable axially and in the circumferential direction, and which can be commonly actuated either by an adjusting ring in each case or else by the one adjusting ring. If two guide rings can be commonly actuated by the one adjusting ring, a synchronous adjustment of the radial gaps of two rotor blade rings can be carried out.

In order to avoid damage to the tips of the blade airfoils of rotor blades in the case of unwanted contact with the wall surface of the guide ring, use is preferably made of an abrasive coating or of a honeycomb-like coating on the inwardly oriented wall surface of the guide ring.

A simple installing of the toothed wheels and adjusting rings which are required for rotating the guide ring is possible if for each toothed wheel provision is made in the passage wall section for a socket arranged on the outer side or inner side, in which a shaft or hub of the toothed wheel can be rotatably mounted or supported. Since the outer ring encompasses all the toothed wheels, their shafts or hubs do not have to be specially secured in the sockets provided for them. Consequently, the shafts or hubs can be simply inserted into the sockets without additional constructional elements being necessary for secure positioning. The use of such elements is not excluded, however.

In order to be able to also use the proposed passage wall section in statically operated axial turbomachines which can be split in half, the guide ring, the passage wall section and/or the adjusting ring, or adjusting rings, can be split into at least two segments in each case, i.e. guide ring segments, wall section segments or adjusting ring segments, which enables assembly of the construction in halves. The passage wall section is preferably used in an axial compressor of a gas turbine exposed to axial throughflow.

The use of the proposed invention is especially of particular interest when the radial gaps which exist in the turbine unit of the gas turbine are adjustable by means of axial displacement of the rotor. Since the flow passage of the turbine unit and the flow passage of the compressor of the gas turbine basically have opposed conical inclinations, displacement of the rotor in the turbine unit leads to a minimization of the radial gap and in the compressor to an opening of the radial gaps. With the proposed passage wall section, the enlarging of the compressor radial gaps which is described as a result of the aforesaid effect can especially be compensated and, if necessary, over-compensated, which, despite the rotor displacement, leads to an improvement of the compressor efficiency and therefore of the efficiency of the gas turbine. The proposed passage wall section is especially suitable for compressors since these are frequently operated within a temperature range which enables the use of the proposed construction in an especially simple manner.

BRIEF DESCRIPTION OF THE DRAWINGS

The previously described invention is subsequently explained in more detail with reference to a single longitudinal sectional view. In the drawing:

FIG. 1 shows a longitudinal section through a detail of an annular flow passage of an axial turbomachine.

DETAILED DESCRIPTION OF INVENTION

The single figure shows in longitudinal section a detail of an annular flow passage 10. The annular flow passage 10 extends concentrically along a machine axis 12 of the turbomachine which is exposed to axial throughflow. The turbomachine which is shown here is designed as a compressor of a gas turbine. The flow passage 10 comprises a wall section 14 which constitutes the radially outer limit of the flow path. Radially on the inside, the flow path is delimited either by an inner wall 16 or by the generated surface of the rotor 18. At various axial positions of the rotor 18, rotor blades 20 are provided in rings. A stator blade ring, with a number of circumferentially distributed stator blades 22 which are retained in each case on the passage wall section 14 by means of an inverted T-shaped fastening, is located between the two depicted rotor blade rings.

Upstream of the flow passage 10 of the compressor, which is exposed to throughflow from left to right in FIG. 1, provision is made in an endlessly encompassing circumferential groove 24 in the wall section 14 for a guide ring 26 which consists of a plurality of segments. The guide ring 26 is located at the axial position of the rotor blade 20 which is shown on the left in FIG. 1. The guide ring 26 has an inwardly oriented wall surface 28. The wall surface 28 delimits the flow path and lies opposite the tips 30 of the rotor blades 20, forming a gap 32. The convergent wall surface 28 in this section is therefore inclined in relation to the machine axis 12 so that it is conically formed.

A plurality of sockets 34 and passages 36 are distributed in pairs over the circumference of the passage wall section 14 radially outside the guide ring 26. Each socket 34 fauns a pocket for a toothed wheel 38. The toothed wheel 38 has a shaft or hub 40 which lies in the socket 34. The toothed wheel 38 projects through the passage 36 and can engage in the external toothing arrangement 35 which is arranged on the outer surface of the guide ring 26. All the toothed wheels 38 are encompassed by a common adjusting ring 42, the internal toothing arrangement 44 of which is in engagement with all the toothed wheels 38. The external toothing arrangement 35 has an axial width which is essentially larger than the axial width of the toothed wheel 38. This is necessary so that the guide ring 26, despite its displacement in the axial direction, is constantly in engagement with the toothed wheels 38.

The guide ring 26 is arranged in the endless circumferential groove 24. A first toothing arrangement 50 is fastened on the guide ring 26 on the end face by means of only schematically represented screws 48. A second toothing arrangement 46 is similarly fastened on the sidewall 27 of the circumferential groove 24, which is shown on the right in FIG. 1. The first toothing arrangement 50 and the second toothing arrangement 46 are in contact in a toothing plane 52. The toothing plane 52 is of sawtooth-like form. It can also be fanned in the style of a Hirth toothing which assists the centering of the guide ring 26. The toothing plane 52, however, is not shown in longitudinal section but rotated by 90° to it, in the style of a developed view. Both toothing arrangements 46, 50 therefore extend in the circumferential direction and not—as shown—in the radial direction.

A push rod 45 is connected to the adjusting ring 42. For axial and radial guiding of the adjusting ring 42, provision is made for retaining elements 47 which are arranged at the sides thereof and fit round the adjusting ring 42 by a collar. The displacement of the guide ring 26 in the axial direction is carried out as a result of a rotation of the adjusting ring 42. By means of the internal toothing arrangement 44, the rotation of the adjusting ring 42 is converted into a rotation of the toothed wheels 38 which transmit their rotation to the guide ring 26. The contacting toothing arrangements 46, 50, on account of their relative movement to each other, then force a displacement of the guide ring 26 in the axial direction, which is to the left in FIG. 1. As a result of this, the conical radial gaps 32 become smaller. The axial return movement of the guide ring 26 is carried out by means of an opposite rotation of the adjusting ring 42 in conjunction with the circumferentially distributed spring elements 54 which are arranged between the other sidewall of the circumferential groove 24 and the guide ring 26 and constantly press said guide ring onto the second toothing arrangement 46.

In addition, provision is made on the wall surface 28 of the guide ring 26 for an abrasive coating 56 which prevents damage in the event of brushing of the blade tips 30 against the guide ring 26.

In the event that the adjusting ring 42 is to commonly actuate two guide rings 26, the retaining elements 47 are correspondingly adapted. The adjusting ring 42 is then formed rather as a drum. Naturally, it is possible to carry out the radial gap adjustment synchronously or independently of an axial rotor displacement of the gas turbine.

Adjusting the size of the radial gaps between the wall surface 28 of the guide ring 26 and the tips 30 of the blades 20 lying opposite this wall surface can already be carried out during initial start-up or else during operation of the turbomachine or of the gas turbine. Additionally or alternatively, the radial gap adjustment can also be carried out in dependence upon a measured, actual radial gap. As a result of making the radial gaps 32 smaller, the radial gap losses are reduced, which leads to an increased energy conversion in the compressor.

By using suitable materials for the toothed wheels 38 and the toothing arrangements 46, 50, lubricant can possibly be dispensed with, which is maintenance-friendly. If applicable, the sliding surfaces of the toothing arrangements 46, 50 are coated with polytetrafluoroethylene (PTFE). This enables a low-loss relative movement of the two toothing arrangements 46, 50.

In all, with the invention a passage wall section 14 of an annular flow passage 10 of an axial turbomachine is disclosed, which passage wall section provides a particularly simple, compact mechanism for adjusting radial gaps 32 between the inner wall surface 28 of a guide ring 26 and the rotor blade airfoil tips 30 which lie opposite this wall surface 28. According to the invention, for this purpose it is provided that the guide ring 26, on the end face, has a first toothing arrangement 50 which is in contact with a second toothing arrangement 46 which is arranged on the sidewall 27 of the circumferential groove 24 which accommodates the guide ring 26, wherein for axial displacement of the displaceable guide ring 26, this is rotatable in the circumferential direction.

The invention claimed is:

1. A passage wall section for an annular flow passage of an axial turbomachine, comprising:

an encompassing circumferential groove in an inwardly pointing surface of the flow passage, and a guide ring which is arranged in the circumferential groove, wherein the guide ring delimits the flow passage, wherein the guide ring is displaceable at least in an axial direction in order to adjust radial gaps which exist between a wall surface of the guide ring and rotor blade airfoil tips opposite the wall surface, wherein the guide ring comprises a first toothing arrangement which is in contact with a second toothing arrangement which is arranged on a sidewall of the circumferential groove, wherein for axial displacement of the displaceable guide ring, the guide ring is rotated in a circumferential direction, and wherein the guide ring is in pretensioned contact with the second toothing arrangement via a spring element or a plurality of spring elements.

2. The passage wall section as claimed in claim 1, wherein the guide ring has an outwardly oriented generated surface with at least one external toothing arrangement, wherein toothed wheels, which are distributed over the circumference of the passage wall section, engage in the at least one external toothing arrangement, the toothed wheels being rotatably mounted in the passage wall, wherein an adjusting ring encompasses the toothed wheels, and wherein at least one internal toothing arrangement of the adjusting ring is in engagement with the toothed wheels.

3. The passage wall section as claimed in claim 2, wherein the adjusting ring is rotatable in a circumferential direction via hydraulically or electrically operated push rods.

4. The passage wall section as claimed in claim 2, wherein at least two guide rings are provided, which are commonly rotatable in the circumferential direction via the one adjusting ring.

5. The passage wall section as claimed in claim 2, wherein each toothed wheel has a socket arranged on the outer side, the socket supporting a shaft or a hub of the toothed wheel.

6. The passage wall section as claimed in claim 2, wherein the adjusting ring comprises at least two adjusting ring segments.

7. The passage wall section as claimed in claim 1, wherein the guide ring has an abrasive coating or a honeycomb-like coating on an inwardly oriented wall surface.

8. The passage wall section as claimed in claim 1, wherein the guide ring comprises at least two guide ring segments.

9. The passage wall section as claimed in claim 1, wherein the passage wall comprises at least two wall section segments.

10. An axial compressor with a passage wall section, the passage wall section comprising:

an encompassing circumferential groove in an inwardly pointing surface of the flow passage, and a guide ring which is arranged in the circumferential groove, wherein the guide ring delimits the flow passage, wherein the guide ring is displaceable at least in an axial direction in order to adjust radial gaps which exist between a wall surface of the guide ring and rotor blade airfoil tips opposite the wall surface, wherein the guide ring comprises a first toothing arrangement which is in contact with a second toothing arrangement which is arranged on a sidewall of the circumferential groove, wherein for axial displacement of the displaceable guide ring, the guide ring is rotated in a circumferential direction, and wherein the guide ring is in pretensioned contact with the second toothing arrangement via a spring element or a plurality of spring elements.

11. The axial compressor as claimed in claim 10, wherein the guide ring has an outwardly oriented generated surface with at least one external toothing arrangement, wherein toothed wheels, which are distributed over the circumference of the passage wall section, engage in the at least one external toothing arrangement, the toothed wheels being rotatably mounted in the passage wall, wherein an adjusting ring encompasses the toothed wheels, and wherein at least one internal toothing arrangement of the adjusting ring is in engagement with the toothed wheels.

12. The axial compressor as claimed in claim 11, wherein the adjusting ring is rotatable in a circumferential direction via hydraulically or electrically operated push rods.

13. The axial compressor as claimed in claim 11, wherein at least two guide rings are provided, which are commonly rotatable in the circumferential direction via the one adjusting ring.

14. The axial compressor as claimed in claim 10, wherein the guide ring has an abrasive coating or a honeycomb-like coating on an inwardly oriented wall surface.

15. A gas turbine with an axial compressor, the axial compressor comprising a passage wall section, the passage wall section comprising:

an encompassing circumferential groove in an inwardly pointing surface of the flow passage, and a guide ring which is arranged in the circumferential groove, wherein the guide ring delimits the flow passage, wherein the guide ring is displaceable at least in an axial direction in order to adjust radial gaps which exist between a wall surface of the guide ring and rotor blade airfoil tips opposite the wall surface, wherein the guide ring comprises a first toothing arrangement which is in contact with a second toothing arrangement which is arranged on a sidewall of the circumferential groove, wherein for axial displacement of the displaceable guide ring, the guide ring is rotated in a circumferential direction, and wherein the guide ring is in pretensioned contact with the second toothing arrangement via a spring element or a plurality of spring elements.

* * * * *